United States Patent [19]

Tong

[11] Patent Number: 4,971,590

[45] Date of Patent: Nov. 20, 1990

[54] PROCESS FOR IMPROVING THE EMISSIVITY OF A NON-BASED TENSION SHADOW MASK

[75] Inventor: Hua-Sou Tong, Mundelein, Ill.

[73] Assignee: Zenith Electronics Corporation, Glenview, Ill.

[21] Appl. No.: 439,992

[22] Filed: Nov. 20, 1989

Related U.S. Application Data

[60] Division of Ser. No. 308,904, Jun. 22, 1988, Pat. No. 4,929,864, which is a continuation-in-part of Ser. No. 127,724, Dec. 7, 1987, abandoned.

[51] Int. Cl.[5] ..... H01J 29/07

[52] U.S. Cl. ..... 445/47

[58] Field of Search ..... 445/47; 148/253, 254; 427/336, 337

[56] References Cited

U.S. PATENT DOCUMENTS 3,867,207 2/1975 Decker et al. ..... 427/337

3,967,985 7/1976 Izumi et al. ..... 148/253

FOREIGN PATENT DOCUMENTS 56345 3/1984 Japan ..... 313/402

1039345 2/1986 Japan ..... 313/402

*Primary Examiner*—Kenneth J. Ramsey

[57] ABSTRACT

The power handling capability of a nickel-iron-based tension foil shadow mask is enhanced by a process which creates a high emissivity layer or region on the surface of the body of the mask. One version of the process includes contacting the mask foil with a strong reducing acid to provide a nickel-enriched, iron-depleted surface layer of the body of the mask. The nickel of the nickel-enriched, iron-depleted surface layer is converted to a nickel phosphide compound by again contacting the foil with a strong reducing acid having an effective amount of hypophosphite ions. In another version of the process, the nickel phosphide compound is formed in a single treatment with a strong reducing acid containing hypophosphite ions.

42 Claims, 2 Drawing Sheets

PROCESS FOR IMPROVING THE EMISSIVITY OF A NON-BASED TENSION SHADOW MASK

CROSS-REFERENCE TO RELATED APPLICATIONS AND PATENTS

This application is a division of application Ser. No. 308,904, filed June 22, 1988, now U.S. Pat. No. 4,929,864, which is in turn a continuation-in-part of application Ser. No. 127,724, filed on Dec. 7, 1987 now abandoned by Michael Livshultz and Hua-Sou Tong for "Improved Material, and Assemblies for Tensioned Foil Shadow Masks", and assigned to the assignee of the present application.

This application is related to but in no way dependent upon co-pending applications Ser. No. 174,660, filed on Mar. 29, 1988, Ser. No. 051,896, filed May 18, 1987 (now U.S. Pat. No. 4,790,786); Ser. No. 060,142, filed June 9, 1987 (now U.S. Pat. No. 4,779,023); Ser. No. 832,556, filed Feb. 21, 1986 (now U.S. Pat. No. 4,695,761): now U.S. Pat. No. 4,695,761; Ser. No. 835,845, filed Mar. 3, 1986 now U.S. Pat. No. 4,725,756); Ser. No. 843,890, filed Mar. 25, 1986 (now U.S. Pat. No. 4,794,299); Ser. No, 866,030, filed Apr. 21, 1986 (now U.S. Pat. No. 4,737,681); Ser. No. 875,123, filed June 17, 1986 (now U.S. Pat. No. 4,745,329); Ser. No. 881,169, filed July 2, 1986 (now U.S. Pat. No. 4,767,962); Ser. No. 948,212, filed Dec. 31, 1986 (now U.S. Pat. No. 4,756,702); Ser. No. 119,765, filed Nov. 11, 1987 (now U.S. Pat. No. 4,776,822); and U.S. Pat. Nos. 4,210,843; 4,593,224; 4,591,344; 4,593,225; 4,595,857; 4,614,892; 4,652,791; 4,656,388; 4,672,260 and 4,678,447, all of common ownership herewith.

BACKGROUND OF THE INVENTION

Cathode ray tubes having flat faceplates and flat tensioned foil shadow masks are known to provide many advantages over conventional cathode ray tubes having a curved faceplate and a curved shadow mask. A chief advantage of a flat faceplate cathode ray tube with a tensioned mask is a greater electron beam power-handling capability, a capability which can provide greater picture brightness. The power-handling capability of tubes having the conventional curved mask is limited due to the thickness of the mask (5 to 7 mils), and the fact that it is not mounted under tension. As a result, the mask tends to expand or "dome" in picture areas of high brightness where the intensity of electron beam bombardment, and consequently the heat, is greatest. Color impurities result when the mask expands toward the faceplate and the beam-passing apertures in the mask move out of registration with their associated phosphor dots or lines on the faceplate.

A tensioned mask when heated acts in a manner quite different from a curved, untensioned mask. For example, if the entire mask is heated uniformly, the mask expands and relaxes the tension. The mask remains planar and there is no doming and no distortion until the mask has expanded to the point that tension is completely lost. Just before all tension is lost, wrinkling may occur in the corners. When small areas of a tensioned foil mask are differentially heated, the heated areas expand and the unheated areas correspondingly contract, resulting in only small displacements within the plane of the mask. However, the mask remains planar and properly spaced from the faceplate and, consequently, any color impurities are unnoticeable.

The mask must be supported in tension in order to maintain the mask in a planar state during operation of the cathode ray tube. The amount of tension required will depend upon how much the mask material expands upon heating during operation of the cathode ray tube. Materials with very low thermal coefficients of expansion need only a low tension. Generally, however, the tension should be as high as possible because the higher the tension, and the greater the electron beam current that can be handled. There is a limit to mask tension, however, as too great a tension can cause the mask to tear.

The mask may be tensioned in accordance with known practices. A convenient method is to thermally expand the mask by means of heated platens applied to both sides of the mask. The expanded mask is then clamped in a fixture and, upon cooling, remains under tension. The mask may also be expanded by exposure to infrared radiation, by electrical resistance heating, or by stretching through the application of mechanical forces to its edges.

PRIOR ART

It is well known in the manufacture of standard color cathode ray tubes of the curved-mask, curved-screen type to heat-treat the masks prior to their being formed into a domed shape. Conventional (non-tensioned) masks are typically delivered to cathode ray tube manufacturers in a work-hardened state due to the multiple rolling operations which are performed on the steel to reduce it to the specified thickness, typically about 6 mils. In order that the masks may be stamped into a domed shape, they must be softened by use of an annealing heat treatment--typically to temperatures on the order of 700°-800° C. Annealing also enhances the magnetic coercivity of the masks, a desirable property from the standpoint of magnetic shielding of the electron beams. After stamping, and the consequent moderate work hardening of the mask which may result from the stamping operation, it is known in the prior art to again anneal the masks while in their domed shape to further enhance their magnetic shielding properties.

Foils intended for use as tensioned masks are also delivered in a hardened state--in fact, much harder than standard masks in order to provide the very high tensile strength needed to sustain the necessary high tension levels; for example, 30,000 psi, or greater. The prior art annealing process, with its relatively high annealing temperatures, would be absolutely unacceptable if applied to flat tension masks, as any extensive softening or reduction of tensile strength of the mask resulting from the process would make the material unsuited for use as a tension mask.

The disclosure of U.S. Pat. No. 4,210,843 to Avedani, of common ownership herewith, sets forth an improved method of making a conventional color cathode ray tube shadow mask; that is, a curved shadow mask having a thickness of about 6 mils, and designed for use with a correlatively curved faceplate. The method comprises providing a plurality of mask blanks composed of an interstitial-free steel, each with a pattern of apertures photo-etched therein, which blanks have been cut from a foil of steel, precision cold-rolled to a full hard condition, and with a thickness of from 6 to 8 mils. A stack of blanks is subjected to a limited annealing operation carried out at a relatively low maximum temperature, and for a relatively brief period sufficient only to achieve recrystallization of the material without causing significant grain growth. Each blank is clamped and drawn to form a dished mask without the imposition of vibration or roller leveling operations, and thus avoids undesired creasing, roller marking, denting, tearing or work-hardening of the blank normally associated with these operations. The end-product mask, due to the use of the interstitial-free steel material, has an aperture pattern of improved definition as a result of more uniform stretching of the mask blank. The annealing operation has little effect on the magnetic properties of this type of steel, and the coercivity of the material, after forming, is about 2.0 oersteds.

A foil shadow mask is maintained under high tension within the cathode ray tube, and the mask is subjected to predetermined relatively high temperatures during tube manufacture. A process for pre-treating a metal foil shadow mask is disclosed in referenced co-pending application Ser. No. 948,212, of common ownership herewith. The process comprises preheating the shadow mask in a predetermined cycle of temperature and time effective to minimize subsequent permanent dimensional changes in the mask that occur when it is subjected to predetermined relatively high temperatures, but ineffective to significantly reduce the tensile strength of the mask by annealing.

Earlier foil mask materials have limitations in terms of the desired combination of mechanical and magnetic properties described herein. One material used for mask applications in flat faceplate cathode ray tubes has been aluminum-killed (AK), AISI 1005 cold-rolled capped steel, generally referred to as "AK steel." AK steel has a composition of 0.04 percent silicon, 0.16 percent manganese, 0.028 percent carbon, 0.020 percent phosphorus, 0.018 percent sulfur, and 0.04 percent aluminum, with the balance iron and incidental impurities. Throughout the specification and claims, all percentages and parts are considered weight-percentages and parts by weight, unless otherwise indicated.) Invar, which has a nominal composition of 36 percent nickel, balance iron, has also been suggested as a possible material for tensioned foil shadow masks. Invar however has a thermal coefficient of expansion far lower than that of the glass commonly used in cathode ray tube faceplates and so is considered generally unacceptable.

The material of the masks treated according to the Serial No. 948,212 disclosure is the aforedescribed AK steel. AK steel, while it can be formed into a fairly acceptable foil shadow mask, is deficient in certain important properties. For example, the yield strength of AK steel foil one mil thick is typically in the range of 75–80 ksi. This makes it only marginally acceptable from a strength standpoint. More importantly, AK steel has a permeability that is much lower than desired, for example, 5,000 in a 1 mil foil. Since the ability of a material to carry magnetic flux decreases with decreasing cross-section, cathode ray tubes having masks made of AK steel thinner than about 1 mil may require both internal and external magnetic shielding. With internal shielding only, the beam landing misregistration due to the earth's magnetic field, i.e., the change in beam landing position upon reversal of the axial field component, is typically 1.5 mils, which is much greater than the maximum of about 1 mil that is generally considered tolerable.

In addition, AK steel is metallurgically dirty, having inclusions, defects and dislocations which interfere with both the foil rolling process and the photo resist etching of the apertures in the foil resulting in higher scrap rates and consequently lower yields.

Another significant disadvantage of an AK steel tensioned foil shadow mask is the fact that as the tension applied is increased, the permeability decreases and the coercivity increases. Translated into picture performance, this means that as the tension of the AK foil shadow mask is increased in order to permit increased beam current and, therefore, greater picture brightness, its ability to shield the electron beams from the earth's magnetic field deteriorates, resulting in increased beam misregistration.

U.S. Pat. No. 3,867,207 to Decker, et al. describes a method for blackening steel components of a cathode ray tube, such as the aperture mask, by immersing the component in an electroless nickel or cobalt plating bath to provide a surface layer of nickel or cobalt on the component in a strong oxidizing acid and firing the component in air at about 450° C. to form a black, complex nickel or cobalt phosphide compound on the surface of the component.

The present invention overcomes the aforementioned limitations of the prior art by providing a tensioned foil shadow mask having a thin surface layer of a blackened nickel compound which substantially increases the emissivity of the shadow mask and retards its rate of temperature increase, thus reducing color purity loss at high electron beam energies and which is provided by a simple process.

OBJECTS OF THE INVENTION

Accordingly, it is an object of the present invention to provide an improved flat tensioned foil shadow mask for use in a color cathode ray tube having a flat faceplate.

Another object of the present invention is to provide an improved process for fabricating a cathode ray tube incorporating a flat tensioned foil shadow mask.

A further object of the present invention is to provide a flat tensioned foil shadow mask having improved mechanical and emissivity properties.

Yet another object of the present invention is to provide for the treatment of prior art flat tensioned foil shadow masks so as to substantially increase their thermal radiation characteristics and current handling capabilities.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), wherein like reference numerals identify like elements, and in which:

FIG. 6 is a flow chart illustrating in simplified form the steps carried out in producing a tensioned foil shadow mask in accordance with the present invention;

DESCRIPTION OF THE PREFERRED EMBODIMENT

To facilitate understanding of the process and material according to the invention and their relation to the manufacture of a color cathode ray tube having a tensioned foil shadow mask, a brief description of a tube of this type and its major components is offered in the following paragraphs.

Figure 1:
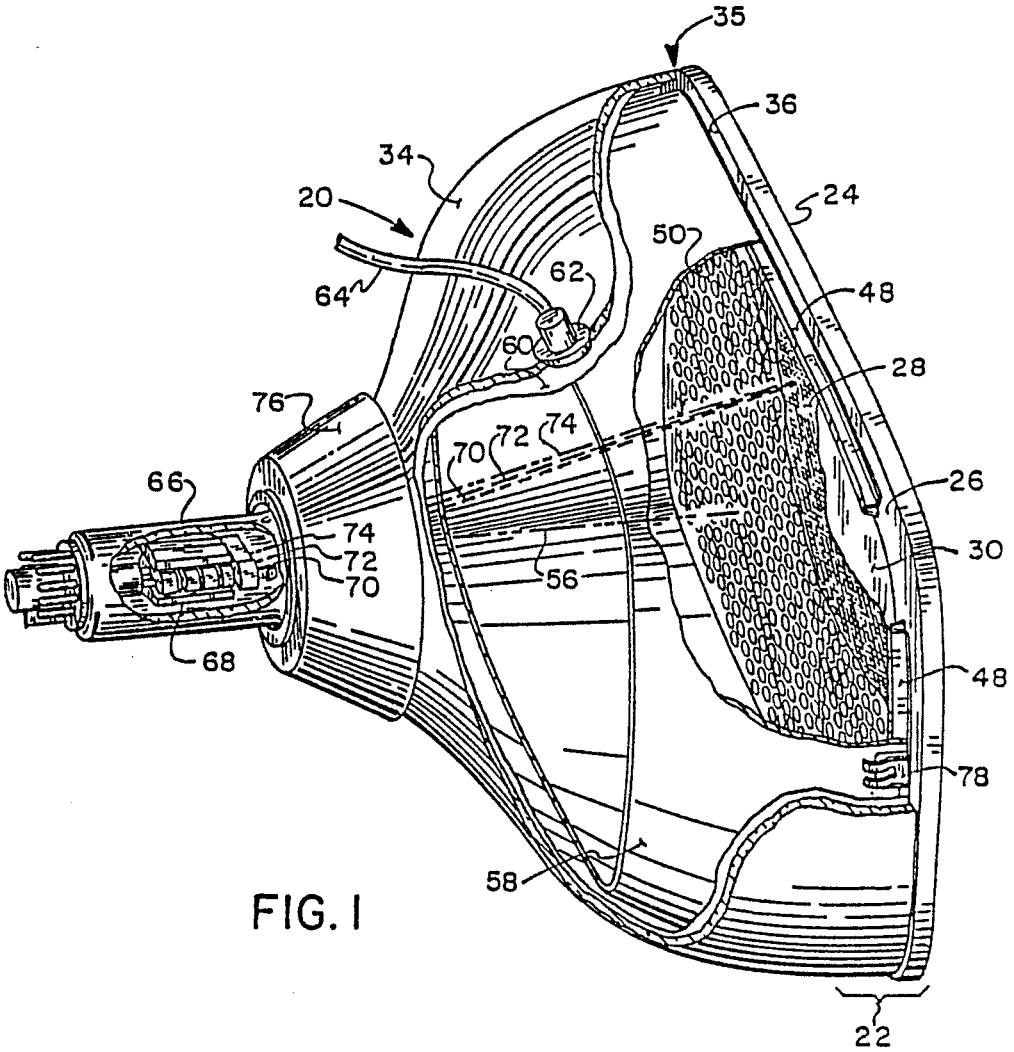
FIG. 1 is a side view in perspective of a color cathode ray tube having a flat faceplate and a tensioned foil shadow mask, with cut-away sections that indicate the location and relation of the faceplate and tensioned foil shadow mask to other major tube components.

A color cathode ray tube 20 having a tensioned foil shadow mask is depicted in FIG. 1. The faceplate assembly 22 essentially comprises a flat faceplate and a tensioned flat foil shadow mask mounted adjacent thereto. Faceplate 24, indicated as being rectangular, is shown as having on its inner surface 26 a centrally located phosphor screen 28 depicted diagrammatically as having a pattern of phosphors thereon. A film of aluminum 30 is indicated as covering the pattern of phosphors. A funnel 34 is represented as being attached to faceplate assembly 22 at their interfaces 35; the funnel sealing surface 36 of faceplate 24 is indicated as being peripheral to screen 28. A frame-like shadow mask support structure 48 is indicated as being located on opposed sides of the screen between funnel sealing surface 36 and screen 28, and mounted adjacent to faceplate 24. Support structure 48 provides a surface for receiving and mounting in tension a metal foil shadow mask 50 a Q-distance away from the screen 28. The pattern of phosphors corresponds to the pattern of apertures in mask 50. The apertures depicted are greatly exaggerated for purposes of illustration; in a high-resolution color tube for example, the mask has as many as 750,000 such apertures, with aperture diameter being on the average about 5 mils. As is well known in the art, the foil shadow mask acts as a color-selection electrode, or "parallax barrier" which ensures that each of the beamlets formed by the three beams lands only on its assigned phosphor deposits on the screen.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete in-line electron beams 70, 72 and 74 for exciting respective red-light-emitting, green-light-emitting, and blue-light emitting phosphor elements deposited on screen 28. Yoke 76 receives scanning signals and provides for the scanning of beams 70, 72 and 74 across screen 28. An electrical conductor 78 is located in an opening in shield 58 and is in contact with conductive coating 60 to provide a high-voltage connection between the coating 60, the screen 28, and shadow mask 50. This means of electrical conduction is described and claimed in referent co-pending application Ser. No. 060,142 of common ownership herewith.

Figure 2:
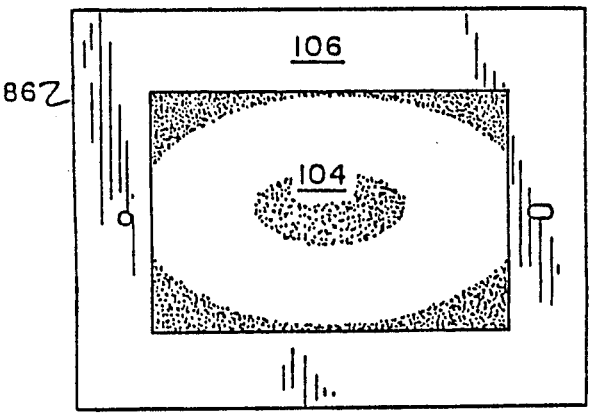
FIG. 2 is a plan view of an in-process foil shadow mask.

Two of the major components, designated as being "in-process," are depicted and described as follows. One is a shadow mask indicated diagrammatically in FIG. 2. In-process shadow mask 86 includes a central area 104 of apertures corresponding to the pattern of phosphors that is photodeposited on the screen of the faceplate by using the mask as an optical stencil. Center field 104 is indicated as being surrounded by an unperforated section 106, the periphery of which is engaged by a tensing frame during the mask tensing and clamping process, and which is removed in a later procedure.

Figure 3:
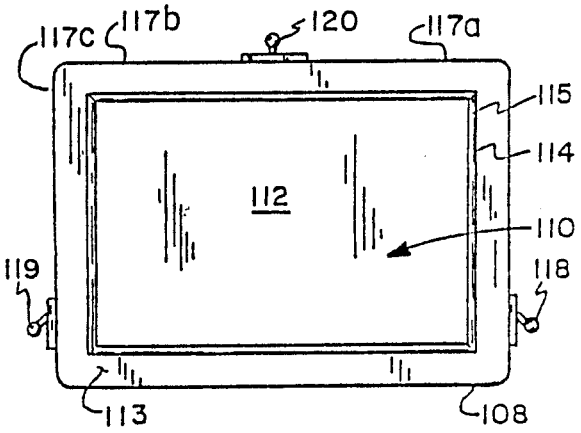
FIG. 3 is a plan view of an in-process flat glass faceplate showing a phosphor screening area and a foil shadow mask support structure secured thereto.

An in-process faceplate 108 is depicted diagrammatically in FIG. 3 as having on its inner surface 110 a centrally located screening area 112 for receiving a predetermined phosphor pattern in an ensuing operation. A funnel sealing surface 113 as indicated as being peripheral to screen 112. A frame-like shadow mask support structure 114 is depicted as being secured on opposed sides of screen 112; the structure provides a surface 115 for receiving and mounting a foil shadow mask under tension a Q-distance from the screen.

A process according to the invention essentially comprises providing an apertured foil shadow mask 86 comprised of a nickel-iron alloy, and securing the mask 86 to the mask support structure 114 of the faceplate 108 while under tension, and in registration with the phosphor screen. The process is further characterized by first subjecting the mask 86 to contact with a strong reducing acid which dissolves iron faster than nickel to provide a nickel-rich surface layer followed by blackening the surface layer by contacting the mask with a mixture of a strong reducing acid and a hypophosphite salt to provide a blackened surface layer of nickel and molybdenum phosphides.

A class of nickel-iron aLloys, desirably containing minor additions of certain alloying agents, when heat-treated and cooled under controlled conditions, yield a material which, when fabricated into a thin foil, has mechanical and magnetic properties not found in known alloys that makes them uniquely suited for use as tensioned foil shadow masks.

With regard to the alloy composition, a nickel-iron alloy is provided comprising between about 30 and 85 weight-percent of nickel, between about 0 and 5 weight-percent of molybdenum, between 0 and 2 weight-percent of one or more of vanadium, titanium, hafnium, and niobium, with the balance iron and incidental impurities; e.g., carbon, chromium, silicon, sulfur, copper and manganese. Typically, the incidental impurities combined do not exceed 1.0 percent. Preferably and also according to the invention, the alloy may comprise between about 75 and 85 weight-percent of nickel, between about 3 and 5 weight-percent of molybdenum, with the balance iron and incidental impurities. Most preferably, the alloy may comprise about 80 weight-percent nickel, about 4 weight-percent molybdenum, with the balance iron and incidental impurities. These examples of foil mask materials are generally referred to as molypermalloys.

MASK HEAT TREATMENT DURING FRIT CYCLE

The heat treatment of the masks described in the following paragraphs closely approximates the processing steps in frit sealing cathode ray tube, and the sealing of the funnel and faceplate in the manufacturing process.

As indicated in FIG. 3 a shadow mask support structure 114 is secured on the inner surface 110 of faceplate 108 between the peripheral sealing area, noted as being the funnel sealing surface 113, and the screening area 112. The mask support structure 114 provides a surface 115 for receiving and supporting a foil shadow mask in tension. The mask support structure 114 may comprise, by way of example, a stainless steel metal alloy according to the disclosure of referent co-pending application Ser. No. 832,556, or alternately, a ceramic structure according to the disclosure of referent co-pending application Ser. No. 866,030. Attachment of the support structure is preferably by means of a devitrifying frit.

The alloy according to the invention is formed into a foil having a thickness of about 0.001 inch or less. A central area 112 of the foil is apertured to form a foil mask 108 consonant in dimensions with the screening area 112 for color selection. Aperturing of the mask can be accomplished by a photo-etching process in which a light-sensitive resist is applied to the foil. The resist is hardened by exposure to light except in those areas where apertures are defined. The exposed metal defining The foil mask is then tensed in a tensing frame to a tension of at least about 25 Newton/centimeters. A tensing frame suitable for use in tensing a mask foil, and the process for tensing, is fully described and claimed in referent co-pending application Ser. No. 051,896, of common ownership herewith. In essence, the foil may be expanded by enclosing it between two platens heated to 360° C. for one minute, clamped in the tensing frame, and air cooling it to provide a tensioned foil having a greater length and width than the faceplate to which it will be secured. A pattern of red-light-emitting, green-light-emitting, and blue-light-emitting phosphor deposits are sequentially photoscreened on screening area 112. The photoscreening process includes repetitively registering the foil to the phosphor screening area by registering the tensing frame with the faceplate. The means of registration is fully set forth in the referent '896 application.

The foil comprising the mask 86 is secured to the mask support structure 114, with the apertures of the mask in registration with the pattern of phosphor deposits on screening area 112. The means for securing the mask to the mask support structure may be by welding with a laser beam, with the excess mask material removed by the same beam, as fully described and claimed in referent co-pending application Ser. No. 058,095, of common ownership herewith. Inasmuch as the faceplate 108 and tensioned foil shadow mask 86 are rigidly interconnected by their mutual attachment to the mask support structure, the thermal coefficient of expansion of the alloy foil must approximate that of the faceplate, which is typically a glass having a coefficient of expansion of between about $12\times10^{-6}$ in/in/°C. This is necessary due to the relatively high temperatures to which the faceplate and mask are subjected during the cathode ray tube manufacturing process. A coefficient of expansion somewhat greater than that of the faceplate can be tolerated, but a coefficient of expansion substantially less than that of the faceplate is to be avoided as this may lead to mask failure during the manufacturing process.

Figure 4:
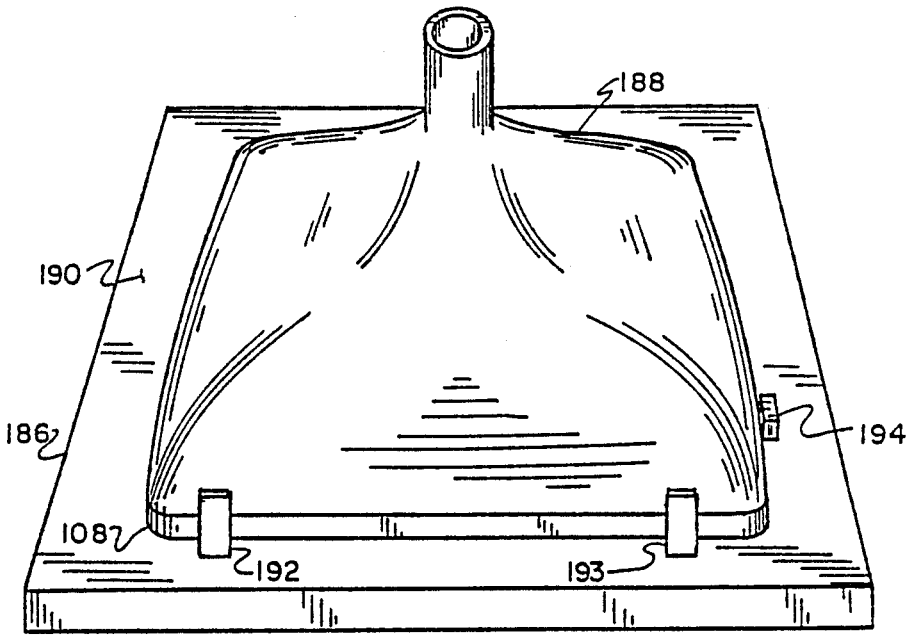
FIG. 4 is a perspective view of a funnel referencing and fritting fixture, with a funnel and the faceplate to which it is to be attached shown as being mounted on the fixture.
Figure 5:
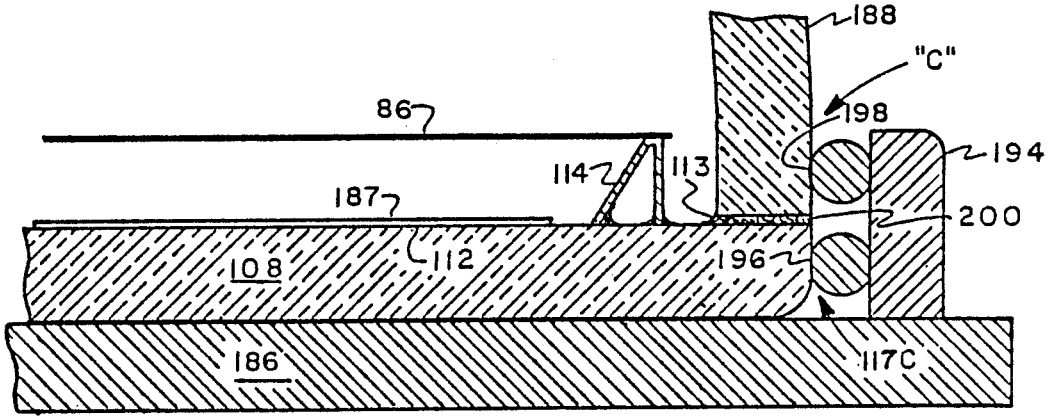
FIG. 5 is a partial detail view in section and in elevation depicting the attachment of a funnel to a faceplate.

FIGS. 4 and 5 depict the use of a funnel referencing and fritting fixture 186 for mating of a faceplate 108 with a funnel 188 to form a faceplate-funnel assembly. Faceplate 108 is indicated as being installed face down on the surface 190 of fixture 186. Funnel 188 is depicted as being positioned thereon and in contact with funnel sealing surface 113, noted as being peripheral to screening area 112 on which is deposited a pattern of phosphors 187 as a result of the preceding screening operation. With reference to FIG. 4, three posts 192, 193 and 194 are indicated as providing for alignment of the funnel and faceplate. FIG. 5 depicts details of the interface between post 194, the faceplate 108, and funnel 188. Flat 117*c* on faceplate 108 is shown as being in alignment with reference area "c" on funnel 188. Shadow mask 86, noted as being in tension, is depicted as being mounted on shadow mask support structure 114; this configuration of a shadow mask support structure is the subject of U.S. Pat. No. 4,686,416 of common ownership herewith.

Post 194 is shown as having two reference points 196 and 198 for locating the funnel 188 with reference to the faceplate 108. The reference points preferably comprise buttons of carbon as they must be immune to the effects of the elevated oven temperature incurred during the frit cycle.

A devitrifiable frit in paste form is applied to the peripheral sealing area of the faceplate 108, noted as being funnel sealing area 113, for receiving funnel 188. The faceplate 108 is then mated with the funnel 188 to form a faceplate-funnel assembly. The frit, which is indicated by reference No. 200 in FIG. 5, may for example, comprise frit No. CV-130, manufactured by Owens-Illinois, Inc. of Toledo, Ohio.

The faceplate-funnel assembly is then heated to a temperature effective to devitrify the frit and permanently attach the funnel to the faceplate, after which the assembly is cooled. The process of fusing of the funnel to the faceplate is generally carried out under conditions referred to as the frit cycle. In a typical frit cycle, the faceplate, to which the tensioned foil mask is adhered, and funnel are slowly heated to 435° C., then cooled to room temperature or slightly thereabove over a period of 3-3-½ hours. The foil must be cooled to the temperature at which the alloy is substantially recrystallized at a cooling rate of less than about 5° C. per minute, preferably less than about 3° C. per minute, and most desirably at a rate of between about 2° C. and about 3° C. per minute. The heating of the assembly and the foil is effective to blacken, or oxidize, a thin surface layer of a nickel compound deposited on the foil mask in accordance with the present invention as described in detail below.

Referring to FIG. 6, there is shown a simplified flow chart for a procedure for treating a foil mask in accordance with the principles of the present invention. The first step at block 210 in the process involves degreasing of the foil tension mask (FTM). The FTM may be degreased by dipping it into a hot alkaline solution for on the order of 10 minutes. The next step at block 212 is the ultrasonic cleaning of the degreased FTM. The degreasing and ultrasonic cleaning procedures remove contaminants from the surface of the FTM which decrease the effectiveness of the subsequent steps.

At step 214, the FTM is immersed in a strong reducing acid bath. Since iron has an electrochemical potential of −440 mV as compared to the electrochemical potential of −250 mV for nickel, the iron can be selectively removed from the surface of the FTM to provide a nickel enriched surface layer. The preferred strong reducing acid is preferably concentrated hydrochloric acid having from about 38% to about 50% HCl. The FTM preferably remains in contact with the strong reducing acid for a period of from about 1 to about 10 minutes while the acid is maintained at a temperature of from about 25° to about 75° C. After treatment with the strong reducing acid a nickel enriched surface layer from about 0.01 to about 0.1 mil. thick is formed which has an average nickel content of from about 75% to about 96% with the balance being primarily molybdenum. After being treated with a strong reducing acid, the FTM is cleaned with water at step 216.

At step 218, the FTM is immersed in a strong reducing acid having a substantial level of hypohosphite ions. A suitable reducing acid is concentrated hydrochloric acid having from about 38% to about 50% HCl. The reducing acid is mixed with an effective amount of a soluble hypophosphite salt, such as sodium hypophosphite or potassium hypophosphite. Any hypophosphite salt which has a solubility of at least about 75 grams in 25° C. water can be used. Preferably, the hypophosphite salt is added to the strong reducing acid at a level from about 50 grams to about 250 grams per liter. The FTM preferably remains in contact with the mixture of acid and hypophosphite salt for a period of from about 5 to about 30 minutes while the acid is maintained at a temperature of from about 25° to about 85° C. After treatment with the mixture of acid and hypophosphite salt, the nickel in the nickel enriched layer (and any molybdenum which may be present) are converted to complex nickel or molybdenum phosphide compounds, such as $Ni_3P_2$, which are black in color. After acid treatment, the FTM is then cleaned in tap water at step 220 to remove any excess acid solution, followed by air blow drying of the iron coated FTM at step 222. The FTM may then be stored until required for use as a shadow mask in the manufacture of flat faceplate cathode ray tubes.

It should be understood that discrete steps 214 and 218 are not required. That is, the formation of the nickel enriched surface layer, as depicted in step 214, and the conversion of the nickel (and any molybdenum which may be present) to complex phosphide compounds, as depicted in step 218, can be accomplished in a single step by immersing the FTM into a strong reducing acid having a substantial level of hypophosphite ions. This alternate method for forming the blackened surface layer of nickel and molybdenum phosphide compounds is shown by the dashed line route in FIG. 6.

After treatment in accordance with the invention to provide a blackened surface layer of complex nickel phosphide compounds, the complex nickel phosphide compound surface layer of the FTM may be stabilized at step 224 by heat treatment prior to use or such stabilization may take place during the first cycle used in the manufacture of the cathode ray tube. In this connection, the complex nickel phosphide compound formed on the surface of the FTM is easily abraded and care must be exercised in handling the FTM prior to the stabilization heat treatment.

In one example of the present invention, the foil mask is heated to a temperature of 435° C. for 55 minutes to effect stabilization. The stabilized and blackened $Ni_3P_2$ surface layer substantially increases the heat dissipating capability of the foil mask and retards the rate of temperature increase of the mask upon bombardment by electron beams by efficiently and effectively radiating away heat buildup so as to minimize its thermal distortion. Heating of the foil mask may be accomplished either before or after the foil mask is secured to the faceplate of a cathode ray tube. In the latter case, foil mask heating may be accomplished during a conventional frit-lehr cycle as described above. In heating the foil mask during the frit-lehr cycle, the assembled faceplate and funnel together with the foil mask was positioned on a belt moving at a speed of 9 inches per minute and was passed through an open furnace and exposed to a peak temperature of 435° C. for 55 minutes. Subjecting the foil mask to temperatures in the range 400° C. to 600° C. for a period ranging from ½ hour to 1 hour has also resulted in stabilizing of the foil mask and a substantial increase in its emissivity.

Referring to Table I, there is shown the results of emissivity measurements of foil masks. The emittance data was taken at 40° C. using a typical IR spectrometer. The upper row of data is for a foil mask treated in accordance with the invention to provide a surface layer of $Ni_3P_2$. Measurements were made in the infrared spectrum at various wavelengths as indicated in the table.

TABLE I

Emissivity of Various Metal Masks After Lehr Cycle

| Material | Emissivity | | |
|---|---|---|---|
| Moly-Permalloy* | 5 μM | 8 μM | 14 μM |
| $Ni_3P_2$ Surface Layer | 0.878 | 0.782 | 0.306 |
| AK Steel-Blackened | 0.757 | 0.645 | 0.528 |

*Moly-Permalloy is the tradename for nickel alloy having 80% nickel, 4% molybdenum, 20% iron, balance impurities.

The lower row of data represents measured thermal emissivity for uncoated AK steel shadow masks after blackening by oxidizing heat treatment. From the measured data it can be seen that the emissivity of the moly-permalloy masks treated in accordance with the invention closely approximates the thermal emissivity of prior art AK steel masks.

There has thus been shown a nickel-iron based flat tensioned foil shadow mask for use in a color cathode ray tube having a blackened, or oxidized, thin surface layer of a complex nickel phosphide compound which substantially increases the emissivity of the shadow mask and, by retarding its rate of temperature increase and reducing shadow mask doming, permits the shadow mask to operate at high electron beam energies and is economically and simply manufactured. More energetic electrons allow for increased brightness of the video image visible on the faceplate of the cathode ray tube. The thin surface layer of a complex nickel phosphide compound is formed on the flat tensioned foil shadow mask by subjecting the foil to a strong reducing acid and an effective level of hypophosphite in using a procedure readily adapted for large scale, commercial fabrication of cathode ray tubes with flat tensioned foil shadow masks. The thin surface layer of a complex nickel phosphide compound is then stabilized, either during frit sealing of the cathode ray tube or by subjecting the shadow mask to high temperature in a separate step.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A process for manufacturing a tensioned mask color cathode ray tube which includes a faceplate having on its inner surface a phosphor screen and a support structure for said mask, the process comprising:

providing a nickel and iron-based apertured foil shadow mask;

immersing said mask in a first bath of a strong reducing acid to provide a nickel enriched surface layer on said mask:

converting the nickel of said enriched surface layer to a nickel phosphide compound by immersing said mask in a second bath of a strong reducing acid having an effective amount of hypophosphite ion; and securing said shadow mask to said support structure while under tension in registration with said phosphor screen.

2. The process according to claim 1 wherein said shadow mask comprises between about 75 and 85 weight-percent nickel, between about 3 and 5 weight-percent molybdenum, with the balance iron and incidental impurities.

3. The process according to claim 1 wherein said mask is stabilized by heat treatment as a discrete step prior to installing said mask on said support structure.

4. The process according to claim 1 wherein said mask is stabilized during, and as a result of, a thermal cycle in the process of sealing said tube.

5. The process according to claim 1 wherein said strong reducing acid is hydrochloric acid.

6. The process according to claim 1 wherein said hypophosphite ion is provided in said second bath by mixing a soluble hypophosphite salt with hydrochloric acid.

7. The process according to claim 6 wherein said hypophosphite salt is selected from the group consisting of sodium hypophosphite and potassium hypophosphite.

8. The process according to claim 6 wherein said hypophosphite salt is present in said bath at a level of from about 50 to about 250 grams per liter of said acid.

9. A process for manufacturing a color CRT, including a glass faceplate and a tension shadow mask foil having improved emissivity for greater electron beam power handling capability, comprising:

providing a nickel-iron based-foil;

in a single step, contacting said foil with a strong reducing acid containing a substantial level of hypophosphite ions to convert nickel in a surface layer of the body of said foil to a nickel phosphide compound;

securing to the faceplate mask support means; and affixing said foil under tension to said mask support means.

10. A process for manufacturing a tensioned mask color cathode ray tube which includes a faceplate having on its inner surface a phosphor screen and a support structure for said mask, the process comprising:

providing an apertured foil shadow mask characterized by being composed of an alloy containing between about 30 and about 85 weight-percent nickel, between about 0 and 5 weight-percent molybdenum, between 0 and 2 weight-percent of one or more of vanadium, titanium, hafnium, and nobium, with the balance iron and incidental impurities;

immersing said mask in a first bath of a strong reducing acid to provide a nickel enriched surface layer on said mask;

converting the nickel of said nickel enriched surface layer to a nickel phosphide compound by immersing said mask in a second bath of a strong reducing acid having an effective amount of hypophosphite ion; and securing said foil mask to said support structure while under tension and in registration with said phosphor screen.

11. The process according to claim 10 wherein said mask is stabilized by heat treatment as a discrete step prior to installing said mask on said support structure.

12. The process according to claim 10 wherein said mask is stabilized during, and as a result of, a thermal cycle in the process of sealing said tube.

13. The process according to claim 10 wherein said mask comprises between about 75 and 85 weight-percent nickel, between about 3 and 5 weight-percent molybdenum, with the balance iron and incidental impurities.

14. The process according to claim 10 wherein said strong reducing acid is hydrochloric acid.

15. The process according to claim 10 wherein said hypophosphite ion is provided in said second bath by mixing a soluble hypophosphite salt with hydrochloric acid.

16. The process according to claim 15 wherein said hypophosphite salt is selected from the group consisting of sodium hypophosphite and potassium hypophosphite.

17. The process according to claim 15 wherein said hypophosphite salt is present in said bath at a level of from about 50 to about 250 grams per liter of said acid.

18. The process according to claim 10 wherein said nickel enriched surface layer is formed and said nickel of said nickel enriched surface layer is converted to a nickel phosphide compound by immersing said mask in a single bath of a strong reducing acid having an effective amount of hypophosphite ion.

19. In the manufacture of a color cathode ray tube including a faceplate having on its inner surface a centrally disposed phosphor screening area embraced by a peripheral sealing area adapted to mate with a funnel, the process comprising:

securing a frame-like shadow mask-support structure on said faceplate inner surface between said peripheral sealing area and said screening area for receiving and supporting a foil shadow mask in tension;

providing a nickel-iron-based alloy;

forming said alloy into a thin foil;

aperturing a central area of said foil to form a mask consonant in dimensions with said screening area for color selection;

immersing said mask in a first bath of a strong reducing acid to provide a nickel enriched surface layer on said mask;

converting the nickel of said nickel enriched surface layer to a nickel phosphide compound by immersing said mask in a second bath of a strong reducing acid having an effective amount of hypophosphite ion;

sequentially photoscreening a pattern of red-light-emitting, green-light-emitting, and blue-light-emitting phosphor deposits on said screening area, including repetitively registering said foil with said phosphor screening area;

securing said foil mask to said mask-support structure with said apertures in registration with said pattern;

applying a devitrifiable frit in paste form to said peripheral sealing area for receiving a funnel;

mating said faceplate with said funnel to form a faceplate-funnel assembly; and heating said assembly to devitrify said frit and permanently attach said funnel to said faceplate and to stabilize said mask.

20. The process according to claim 19 wherein said nickel-iron-based alloy is comprised of between about 30 and about 85 weight-percent nickel, between about 0 and 5 weight-percent molybdenum, between 0 and 2 weight-percent of one or more of vanadium, titanium, hafnium and niobium, with the balance of iron and incidental impurities.

21. The process according to claim 19 wherein said non nickel-iron-based alloy is comprised of between about 75 and 85 weight-percent nickel, between about 3 and 5 weight-percent molybdenum, with the balance iron and incidental impurities.

22. The process according to claim 19 wherein said mask is stabilized by heating said mask prior to securing said mask to said mask support structure.

23. The process according to claim 22 wherein said mask is heated to a temperature on the order of 435° C. for approximately 55 minutes.

24. The process according to claim 19 wherein the nickel enriched surface layer on said mask is from about 0.01 to about 1 mil thick.

25. The process according to claim 19 wherein said strong reducing acid is hydrochloric acid.

26. The process according to claim 19 wherein said hypophosphite ion is provided in said second bath by mixing a soluble hypophosphite salt with hydrochloric acid.

27. The process according to claim 26 wherein said hypophosphite salt is selected from the group consisting of sodium hypophosphite and potassium hypophosphite.

28. The process according to claim 26 wherein said hypophosphite salt is present in said bath at a level of from about 50 to about 250 grams per liter of said acid.

29. The process according to claim 19 wherein said nickel enriched surface layer is formed and said nickel of said nickel enriched surface layer is converted to a nickel phosphide compound by immersing said mask in a single bath of a strong reducing acid having an effective amount of hypophosphite ion.

30. A process for treating a nickel-iron-based alloy to provide a blackened surface suitable for making a foil shadow mask for use in a tensioned mask color cathode ray tube having a desirable emissivity, said process comprising:

providing a foil composed of an alloy containing between about 30 and about 85 weight-percent nickel, between about 0 and 5 weight-percent molybdenum, between 0 and 2 weight-percent of one or more of vanadium, titanium, hafnium, and niobium, with the balance iron and incidental impurities;

immersing said foil in a first bath of a strong reducing acid to provide a nickel enriched surface on said foil; and converting the nickel of said nickel enriched surface layer to nickel phosphide compound by immersing said foil in a second bath of a strong reducing acid having an effective amount of hypophosphite ion.

31. A process in accordance with claim 30 wherein the alloy comprises between about 75 weight-percent and about 85 weight-percent of nickel, between about 3 weight-percent and about 5 weight-percent of molybdenum, with the balance iron and incidental impurities.

32. A process in accordance with claim 30 wherein the nickel phosphide surface layer is stabilized by heating said foil to a temperature on the order of 435° C. for approximately 55 minutes.

33. A process in accordance with claim 32 wherein said foil in the form of a shadow mask is heated in a sealing assembly step during fabrication of the color cathode ray tube.

34. The process according to claim 30 wherein said strong reducing acid is hydrochloric acid.

35. The process according to claim 30 wherein said hypophosphite ion is provided in said second bath by mixing a soluble hypophosphite salt with hydrochloric acid.

36. The process according to claim 35 wherein said hypophosphite salt is selected from the group consisting of sodium hypophosphite and potassium hypophosphite.

37. The process according to claim 35 wherein said hypophosphite salt is present in said bath at a level of from about 50 to about 250 grams per liter of said acid.

38. The process according to claim 30 wherein said nickel enriched surface layer is formed and said nickel of said nickel enriched surface layer is converted to a nickel phosphide compound by immersing said mask in a single bath of a strong reducing acid having an effective amount of hypophosphite ion.

39. A process for manufacturing a color CRT tension shadow mask foil having improved emissivity for greater electron beam power handling capability, comprising providing a nickel-iron-based foil, contacting said foil with a strong reducing acid and converting the nickel in a layer on the surface of the body of said foil to a nickel phosphide compound.

40. The process defined by claim 39 wherein said foil is first contacted with a strong reducing acid to nickel enrich and iron deplete said surface layer of said foil, followed by again contacting said foil with a strong reducing acid containing a substantial level of hypophosphite ions to form said nickel phosphide layer in said foil.

41. The process defined by claim 39 wherein said foil is contacted with a strong reducing acid containing a substantial level of hypophosphite ions to convert, in a single step, nickel in said foil body surface layer to said nickel phosphide compound.

42. A process for manufacturing a color CRT, including a glass faceplate and a tension shadow mask foil having improved emissivity for greater electron beam power handling capability, said process comprising:

providing a nickel-iron-based foil;

contacting said foil first with a strong reducing acid to nickel enrich and iron deplete a surface layer of the body of said foil;

again contacting said foil with a strong reducing acid containing a substantial level of hypophosphite ions to form a nickel phosphide layer in said surface of said body of said foil;

securing to the faceplate mask support means; and affixing said foil under tension to said mask support means.

* * * * *